US009211559B2

(12) United States Patent
Law et al.

(10) Patent No.: US 9,211,559 B2
(45) Date of Patent: Dec. 15, 2015

(54) DISPENSERS

(71) Applicant: Rieke Corporation, Auburn, IN (US)

(72) Inventors: Brian Robert Law, Leicester (GB); David John Pritchett, Ashby de la Zouch (GB); Roy Cox, Alderton (GB)

(73) Assignee: RIEKE CORPORATION, Auburn, IN (US)

( * ) Notice: Subject to any disclaimer, the term of this patent is extended or adjusted under 35 U.S.C. 154(b) by 0 days.

(21) Appl. No.: 13/727,873

(22) Filed: Dec. 27, 2012

(65) Prior Publication Data

US 2013/0112712 A1 May 9, 2013

Related U.S. Application Data

(63) Continuation of application No. PCT/GB2011/001001, filed on Jul. 1, 2011.

(30) Foreign Application Priority Data

Jul. 1, 2010 (GB) ..... 1011144.1

(51) Int. Cl.
*B67D 1/00* (2006.01)
*B05B 11/00* (2006.01)

(52) U.S. Cl.
CPC ..... *B05B 11/306* (2013.01); *B05B 11/0048* (2013.01); *B05B 11/0072* (2013.01); (Continued)

(58) Field of Classification Search
CPC .... B65D 83/222; B65D 83/24; B65D 83/205; B05B 11/3001; B05B 11/3057; B05B 11/3059; A62C 11/005
USPC ..... 222/256, 259, 321.7, 321.9, 387, 494, 222/491, 496, 495, 571, 258, 257, 511, 222/153.13, 321.8, 321.1, 501, 322, 153.11, 222/153.12, 402.11, 384; 141/114; 604/275, 278, 245, 249, 68, 69, 70
See application file for complete search history.

(56) References Cited

U.S. PATENT DOCUMENTS 1,283,050 A 10/1918 Berg
2,469,746 A 5/1949 Sanchis
(Continued)

FOREIGN PATENT DOCUMENTS

DE 39 29 064 A 1/1991
EP 0 098 939 A2 1/1984
(Continued)

OTHER PUBLICATIONS

European Patent Application 04255318 Search Report mailed Jun. 14, 2006.
(Continued)

*Primary Examiner* — Patrick M Buechner
(74) *Attorney, Agent, or Firm* — Woodard Emhardt Moriarty McNett & Henry LLP; James Durlacher

(57) ABSTRACT

Pump dispenser, particularly a movable-nozzle pump dispenser, is intended especially for use in dispensing oral medicines e.g. to children. One feature disclosed is a tooth or ratchet structure engageable between the plunger head and the pump cylinder body. This enables optional holding of the plunger at an intermediate position during a dispensing stroke, so that a dose can be given bit by bit. Other proposals are formations around the top of the cylinder body which interact with the inside of the plunger to control or limit movement of the plunger according to their relative rotational orientation. For example the plunger may be locked up unless turned forcibly past a rotational stop. A related feature is a spring lock tab preventing rotation of the plunger unless the tab is pressed to release it. The product container may contain balls to cause agitation.

47 Claims, 6 Drawing Sheets

(52) U.S. Cl.
CPC ..... *B05B11/0075* (2013.01); *B05B 11/3005* (2013.01); *B05B 11/3023* (2013.01); *B05B 11/3046* (2013.01); *B05B 11/3067* (2013.01); *B05B 11/3074* (2013.01); *B05B 11/3007* (2013.01)

(56) References Cited

U.S. PATENT DOCUMENTS

| | | | | |
|---|---|---|---|---|
| 2,774,517 | A | 12/1956 | Teegardin et al. | |
| 2,919,056 | A | 12/1959 | Collins | |
| 3,379,136 | A | 4/1968 | Corsette | |
| 4,118,152 | A | 10/1978 | Bron | |
| 4,277,001 | A | 7/1981 | Nozawa | |
| 4,286,736 | A | 9/1981 | Corsette et al. | |
| 4,343,417 | A * | 8/1982 | Corsette | 222/153.13 |
| 4,360,130 | A | 11/1982 | Nishimura et al. | |
| 4,364,718 | A | 12/1982 | Beun et al. | |
| 4,371,098 | A | 2/1983 | Nozawa et al. | |
| 4,376,495 | A | 3/1983 | Spatz | |
| 4,496,082 | A * | 1/1985 | Corsette | 222/153.13 |
| 4,511,065 | A * | 4/1985 | Corsette | 222/153.13 |
| 4,515,298 | A | 5/1985 | Czech | |
| 4,589,573 | A | 5/1986 | Tada | |
| 4,673,109 | A | 6/1987 | Cassia | |
| 4,775,079 | A | 10/1988 | Grothoff | |
| 4,776,498 | A | 10/1988 | Maerte et al. | |
| 4,790,442 | A | 12/1988 | Gach | |
| 4,811,871 | A | 3/1989 | Wass et al. | |
| 4,856,679 | A * | 8/1989 | Czech | 222/136 |
| 4,872,596 | A * | 10/1989 | Corsette | 222/380 |
| 4,890,773 | A * | 1/1990 | Corsette | 222/380 |
| 4,958,752 | A | 9/1990 | Maerte et al. | |
| 5,016,780 | A | 5/1991 | Moretti | |
| 5,096,094 | A * | 3/1992 | Guilbert | 222/153.13 |
| 5,115,980 | A | 5/1992 | Skorka | |
| 5,165,577 | A | 11/1992 | Ophardt | |
| 5,282,552 | A | 2/1994 | Ophardt | |
| 5,353,969 | A | 10/1994 | Balderrama | |
| 5,373,970 | A | 12/1994 | Ophardt | |
| 5,401,148 | A | 3/1995 | Foster et al. | |
| 5,431,309 | A | 7/1995 | Ophardt | |
| 5,445,288 | A | 8/1995 | Banks | |
| 5,462,204 | A | 10/1995 | Finn | |
| 5,489,044 | A | 2/1996 | Ophardt | |
| 5,548,943 | A | 8/1996 | Behar et al. | |
| 5,676,277 | A | 10/1997 | Ophardt | |
| 5,738,250 | A | 4/1998 | Gillingham et al. | |
| 5,813,576 | A | 9/1998 | Iizuka et al. | |
| 5,878,916 | A * | 3/1999 | DeJonge | 222/153.13 |
| 5,904,272 | A | 5/1999 | Kaufman et al. | |
| 5,975,360 | A | 11/1999 | Ophardt | |
| 5,988,456 | A | 11/1999 | Laible | |
| 6,045,008 | A | 4/2000 | Gonzalez et al. | |
| 6,053,368 | A | 4/2000 | Geimer | |
| 6,062,433 | A * | 5/2000 | Fuchs | 222/153.13 |
| 6,082,586 | A | 7/2000 | Banks | |
| 6,126,042 | A | 10/2000 | Meshberg | |
| 6,179,164 | B1 * | 1/2001 | Fuchs | 222/82 |
| 6,240,979 | B1 | 6/2001 | Lorscheidt | |
| 6,257,454 | B1 * | 7/2001 | Ritsche | 222/153.13 |
| 6,343,724 | B1 | 2/2002 | Ophardt et al. | |
| 6,409,050 | B1 | 6/2002 | Ophardt et al. | |
| 6,516,976 | B2 | 2/2003 | Lewis et al. | |
| 6,533,145 | B2 | 3/2003 | Lewis et al. | |
| 6,540,117 | B2 | 4/2003 | Powling | |
| 6,540,157 | B2 | 4/2003 | Ophardt | |
| 6,543,651 | B2 | 4/2003 | Lewis et al. | |
| 6,557,736 | B1 | 5/2003 | Ophardt | |
| 6,575,334 | B2 | 6/2003 | Lewis et al. | |
| 6,575,335 | B2 | 6/2003 | Lewis et al. | |
| 6,601,736 | B2 | 8/2003 | Ophardt et al. | |
| 6,626,330 | B2 * | 9/2003 | Ritsche | 222/153.02 |
| 7,004,356 | B1 | 2/2006 | Sayers | |
| 7,011,237 | B1 | 3/2006 | Sayers et al. | |
| 7,044,339 | B1 | 5/2006 | Kuo | |
| 7,104,426 | B2 | 9/2006 | Suzuki | |
| 7,325,704 | B2 | 2/2008 | Kasting | |
| 7,367,476 | B2 | 5/2008 | Law et al. | |
| 7,461,762 | B2 | 12/2008 | Law et al. | |
| 7,654,418 | B2 | 2/2010 | Law et al. | |
| 7,690,535 | B2 | 4/2010 | Law et al. | |
| 7,798,348 | B2 | 9/2010 | Sawyer | |
| 7,891,522 | B2 | 2/2011 | Law et al. | |
| 8,556,130 | B2 | 10/2013 | Law et al. | |
| 2002/0027144 | A1 | 3/2002 | Lacout | |
| 2002/0148860 | A1 | 10/2002 | Cohen et al. | |
| 2002/0190083 | A1 * | 12/2002 | Ritsche | 222/321.9 |
| 2003/0132252 | A1 | 7/2003 | Rossignol | |
| 2003/0201286 | A1 | 10/2003 | Ophardt | |
| 2004/0129733 | A1 | 7/2004 | Schultz | |
| 2004/0217137 | A1 | 11/2004 | Ophardt | |
| 2005/0035153 | A1 | 2/2005 | Brown | |
| 2005/0051579 | A1 | 3/2005 | Kasting | |
| 2005/0133475 | A1 | 6/2005 | Goto et al. | |
| 2005/0205607 | A1 | 9/2005 | Hierzer et al. | |
| 2006/0043117 | A1 | 3/2006 | Law et al. | |
| 2007/0200010 | A1 | 8/2007 | Girerd | |
| 2007/0215643 | A1 | 9/2007 | Law et al. | |
| 2008/0083782 | A1 | 4/2008 | Heusser et al. | |
| 2008/0197149 | A1 | 8/2008 | Law et al. | |
| 2008/0217359 | A1 * | 9/2008 | Bougamont | 222/153.13 |
| 2008/0308183 | A1 | 12/2008 | Law | |
| 2009/0212074 | A1 | 8/2009 | Brouwer | |
| 2009/0218008 | A1 * | 9/2009 | Law | 141/311 R |
| 2010/0276515 | A1 | 11/2010 | Milanese | |
| 2012/0097714 | A1 | 4/2012 | Hoefte et al. | |
| 2012/0261418 | A1 | 10/2012 | Cronin et al. | |
| 2013/0200106 | A1 | 8/2013 | Kang | |
| 2014/0312072 | A1 | 10/2014 | Knight et al. | |

FOREIGN PATENT DOCUMENTS

| | | | |
|---|---|---|---|
| EP | 0 274 256 | A1 | 7/1988 |
| EP | 0 327 421 | A1 | 8/1989 |
| EP | 0 389 688 | A2 | 10/1990 |
| EP | 0 509 863 | A1 | 10/1992 |
| EP | 0 600 286 | A2 | 6/1994 |
| EP | 0 703 831 | B1 | 12/1998 |
| EP | 1 015 341 | B1 | 7/2000 |
| EP | 1 092 447 | A2 | 4/2001 |
| EP | 1 190 775 | A1 | 3/2002 |
| EP | 1 449 595 | A1 | 8/2004 |
| EP | 1 514 607 | A2 | 3/2005 |
| EP | 1 629 900 | A2 | 3/2006 |
| EP | 1 671 705 | A1 | 6/2006 |
| EP | 1 676 640 | A1 | 7/2006 |
| EP | 2 095 882 | A1 | 9/2009 |
| EP | 2 133 153 | A1 | 12/2009 |
| EP | 2 153 908 | A1 | 2/2010 |
| EP | 2 353 727 | | 8/2011 |
| GB | 1149805 | | 4/1969 |
| GB | 2360273 | A | 9/2001 |
| GB | 2360273 | A | 9/2001 |
| JP | H08-011921 | A | 9/2001 |
| WO | WO 99/49769 | A1 | 10/1999 |
| WO | WO 03/101620 | A1 | 12/2003 |
| WO | WO 2005/049477 | A2 | 6/2005 |
| WO | WO 2010/023462 | A1 | 4/2010 |
| WO | WO 2012/001375 | A1 | 1/2012 |

OTHER PUBLICATIONS

European Patent Application 05256914.2 Extended Search Report mailed Mar. 2, 2006.

European Search Report in EP 11250032.7 dated May 20, 2011.

Hygiene-Technik Inc., A member of the Ophardt Group of Companies, UX10 Lotion or Foam Soap Dispenser, 2004, pp. 2.

PCT/GB2011/001001 Search Report and Written Opinion dated Nov. 24, 2011.

PCT/GB2011/001002 Search Report and Written Opinion dated Sep. 26, 2011.

(56) References Cited

OTHER PUBLICATIONS

Pictures of Umbrella Valve from RD Industries of Omaha, Nebraska (Pictures 1-6), Jan. 4, 2005.
United Kingdom Patent Application 1100129.4 Search Report mailed Mar. 23, 2011.
PCT/IB2013/050101 International Preliminary Report on Patentability dated Jul. 8, 2014.

U.S. Appl. No. 12/685,064 to David John Pritchett, Office Action mailed Aug. 17, 2012.

* cited by examiner

DISPENSERS

CROSS REFERENCE TO RELATED APPLICATIONS

This application is a continuation of International Application No. PCT/GB2011/001001 filed Jul. 1, 2011, which claims the foreign priority benefit of United Kingdom Application No. GB1011144.1 filed Jul. 1, 2010, both of which are hereby incorporated by reference.

BACKGROUND

This invention has to do with dispensers for fluid products. Certain aspects of our proposals are particularly useful in relation to the dosing of medicines, but the proposals have wide application.

We are concerned with pump dispensers, having a pump chamber with a valved inlet communicating with a supply container for fluid product. An outlet from the pump chamber is preferably also valved. The pump chamber volume is changed from maximum to minimum in a pumping stroke of a pump plunger moving relative to a pump body. The pump chamber may be defined by a deformable container or, more usually, between piston and cylinder components comprised in or carried by one or other of the body and plunger. In moveable-nozzle dispensers the outlet is in the plunger. In fixed-nozzle dispensers the outlet is in the body. Most of these dispensers have a generally vertically-operating plunger and the pump is mounted at the top of a container for the product, but variants are known.

Any volume can be dispensed, including only a part of the pump chamber volume, but the availability of a fixed-volume dose corresponding to the pump chamber volume is significant. One possible dosing application is in the administration of liquid medicines to humans or animals.

SUMMARY

One aspect of the disclosed embodiments pertains to incremental dispensing. This first aspect is applicable in general in dispensers of the kind described, having a plunger operable reciprocally relative to a pump body, and preferably a piston-cylinder pump. The plunger has inward and outward limit positions, usually in practice top and bottom positions which are called top and bottom from now on for convenience, although the dispenser may have other orientations. A dispensing stroke from the top to the bottom reduces the chamber volume to dispense fluid product from the outlet. A recovery stroke from the bottom to the top increases the pump chamber volume to refill the pump chamber with fluid product from the container, through the inlet. The plunger is biased, preferably spring biased, towards the top position. The top and bottom limit positions are usually defined by limit engagements of the plunger with the pump body.

According to the disclosed embodiments, an intermediate position retainer mechanism is provided, operable to engage between the plunger and pump body to retain the plunger at an axially intermediate position, between the top and bottom positions, by preventing it from recovering to the top position. The retaining mechanism can also be disengaged to allow the plunger to recover to the top.

The retainer mechanism may define one or plural intermediate positions, e.g. from 1 to 10, more usually from 2 to 6, between the top and bottom limits. The predetermined intermediate positions may divide the stroke into portions or increments of substantially equal size.

Alternatively the retainer mechanism may provide a substantially continuous range of positions over the stroke at any of which, by engaging the mechanism, the plunger may be retained.

The retainer mechanism preferably comprises detent or abutment formations on respective opposed portions of the plunger and pump body, engageable with one another to retain the plunger position relative to the body against the biasing force. A relative movement of the detent formations for engagement/disengagement is desirably perpendicular or transverse to the plunger movement axis, e.g. radial relative thereto.

Preferably the respective detent formations of the body and plunger are resiliently urged towards an engaged condition so as to engage and retain the plunger automatically if the plunger is released below the defined intermediate position. For this, a detent formation may be provided on a resilient portion or member on the pump body or plunger, preferably formed integrally with it. This may be a resilient limb formed integrally with the body or plunger. Such a limb may extend generally in the axial direction.

One or both detent formations can be shaped as a pawl, i.e. with a ramp face at one side allowing the other formation to slide past in one direction, and an abutment formation at the other face to retain it in the other direction. Thus the formations may ride over one another, e.g. against resilience, on the dispensing stroke.

In a preferred formation, one of the plunger stem, plunger shell or plunger piston on the one hand, and on the other hand the pump body e.g. pump cylinder or body portion integral with the cylinder, is provided with one or more integral (e.g. pawl-form) detent formations, and the other is formed with an integral resilient limb carrying a tooth or hook (e.g. pawl form) to engage with it, at least one being in pawl form.

Resilient overriding of the opposed detent formations may give an audible or otherwise sensible click signal to indicate that a predetermined position has been reached.

The dispenser generally comprises means for positively disengaging the retainer mechanism, and maintaining it disengaged, to allow the plunger to rise freely. Preferably the plunger can be rotated to a released working condition relative to the pump body in which the detent formations of the retainer mechanism are out of alignment with one another and do not engage. Additionally or alternatively a release actuator may be provided which moves one of the detent formations to a different position relative to its mounting, in which it cannot engage the other.

Preferably the mechanism includes a guide or track engagement between the plunger and the body for stabilising or holding their relative rotational alignment with the retainer mechanism aligned for engagement. Additionally or alternatively, a guide or track may be provided for holding their relative rotational alignment so that the plunger can rise and fall with the retainer mechanism out of alignment, i.e. maintained disengaged.

To provide such a guide, one of the plunger and body may have an axial track in which a protrusion of the other can run. The protrusion may be releasable from the track by deformation against resilience e.g. of the protrusion itself which may be a spring or sprung element. In a preferred embodiment an outer surround of the pump body has an inwardly-directed track engageable with an outwardly-directed protrusion on a peripheral portion of the plunger, e.g. on a skirt, shell or casing thereof.

The above-described features can have various valuable applications, depending on the use of the dispenser. When the plunger is released at a part-depressed position, it does not rise fully but instead is held at the intermediate position by the retainer mechanism. If the override of the mechanism has a sensible click, the user can deliberately stop the plunger at the selected position with negligible over-run. The remainder of the "dose" corresponding to a fully plunger stroke can be dispensed separately. Depending on the number of axially-distributed detents and their spacing the dose may be divided into corresponding increments. Thus, the dispensing of a known dose can be gradual or interrupted, without the user needing to hold the plunger at an intermediate position to avoid recovery of the plunger refilling the pump chamber so that control of the dose is lost. This has particular benefits e.g. in the administration of liquid medicines to children or babies who must have a prescribed dose but may be unwilling or unable to accept it all at once.

Preferably the dispenser also has a locked condition in which a lock engagement between the plunger and pump body prevents the plunger from being depressed from the top position. This position may correspond to a particular rotational alignment, or range of rotational alignments, between plunger and body. A lock, limit stop or other retainer may be provided to hold the plunger and body in the locked alignment and/or to assist locating the locked alignment. The plunger and pump body may also make a limit stop engagement to assist in locating the working alignment in which the plunger can be depressed.

Another aspect of the disclosed embodiments pertains to rotational locking and plunger control. This disclosure includes general proposals for new ways of using the rotational alignment of a dispenser plunger relative to the pump body to control locked and operating conditions of the pump plunger. These proposals are fully combinable with the first aspect above, and preferably are used to implement the first aspect above, but can be used in other kinds of dispenser without the intermediate position retaining mechanism for the plunger.

A first proposal as disclosed herein relates to dispensers in which the pump body includes an upstanding cylinder and the pump plunger includes a surround wall or shell which moves up and down around the pump body cylinder as the plunger moves. According to our proposal a plunger control mechanism comprises one or more upstanding peripheral wall formations around the top of the body cylinder, preferably formed integrally with it, defining one or more circumferentially-localised abutments and/or stops and/or notches. The inside of the plunger shell has one or more corresponding abutment formations, e.g. an inwardly-projecting lug, engageable with the upstanding formation(s) on top of the cylinder to limit and control the movement of the plunger relative to the body. Particular formations may include any one or more of the following:

(i) an upwardly-directed surface of the body wall formation, engageable by a downwardly-directed surface of the plunger abutment, around part of the cylinder circumference, preventing the plunger from being depressed;

(ii) a downward slot in a said wall formation providing clearance for the plunger projection to descend, corresponding to a working position of the pump when the plunger abutment is rotationally aligned with the slot;

(iii) a rotational limit stop abutment, projecting upwardly on the wall formation relative to an upward abutment surface as mentioned in (i) above, which—in at least one rotational sense—the plunger abutment cannot pass even at its top position, thereby limiting rotation range of the plunger relative to the body e.g. so as to locate the plunger at a locked or at a working position: to locate a working position the limit stop may be immediately bordering a slot as in (ii).

Additionally such an upstanding peripheral formation on the cylinder body may be or comprise a series of incremental teeth, or a resilient limb carrying a tooth or pawl, for an embodiment of the first aspect above.

Such an upstanding wall formation may be present around at least half or at least three quarters of the cylinder circumference. An accessible slot providing a working condition may be present over only a minor angle, e.g. over less than 45° of rotation.

Respective limit stops (iii) may limit the rotational alignment of the plunger to a limited operational sector relative to the body. One option herein is that a limit stop has a ramp face on the side away from this operational sector. The pump is provided initially (e.g. for shipping or sale) with the plunger abutment on a wall top face preventing plunger depression but outside the operational sector. The pump is brought into an operational condition by forced rotation of the plunger so that its abutment rides over the ramp face of the limit stop and into the operating sector. It is then prevented from returning by the stop face on the other side.

Another proposal as disclosed herein relates to rotational control elements at an outer periphery of the plunger shell, casing or skirt where it lies close inside an inwardly-directed portion of the pump body, e.g. a surround portion of a body mounting element that connects the pump to the top of a container. One of the body surround and plunger casing has a locking recess at a particular circumferential position, the other (preferably the plunger casing) has a resilient locking projection which engages releasably in the recess. A further locking recess may be provided, circumferentially spaced from the first, defining a second rotationally-locked position. Desirably the locking projection is a curved spring element formed integrally with the plunger casing. The locking projection and/or the locking recess may have a pawl form, with an abutment face in one (circumferential) direction and a ramp face in the other. The projection may have a protruding push tab whereby it can be pushed by hand resiliently out of engagement with a said locking recess, allowing the plunger to turn. If there is a pawl form, the push tab is necessary for turning in the abutment direction but turning may be effected in the ramp direction by rotational force applied to the plunger to overcome the projection's resilience.

Where a said locking recess corresponds to a rotational alignment for a working condition (the plunger can be depressed), a corresponding track recess may extend axially from the recess at the rest position (i.e. with the plunger at the top). This can guide the plunger with maintained rotational alignment, e.g. for engaged or disengaged conditions of an incremental dosing feature as in the first aspect.

Such a locking mechanism introduces a child-resistant attribute, especially significant with hazardous materials or medicines, because coordinated action is required to release the rotational lock and turn the plunger, combined with knowledge of the direction in which it must be turned to reach the operational sector or clearance slot.

Another aspect of the disclosed embodiments pertains to product agitation. With products liable to settling or separation it is known to include a loose stirrer body such as a metal ball (in principle any material substantially denser than the product can be effective) in the container. When shaken it agitates the contents to keep them mixed.

As disclosed herein, our proposal, which is independent but may be desirably combined with any of the above proposals, the dispenser comprises a retaining clip facing onto the container interior which holds the stirrer body at a retained position, but can be broken or deformed to release the stirrer body under a sufficient force e.g. by knocking or shaking the dispenser. The clip formation may be integral with the base of a dispenser pump unit fitting into an opening of the container, or integral with a follower plate in the container which rises up the container as product is dispensed. The clip may comprise a deformable limb with a recess shaped to engage the stirrer body and hold it against a counter-element such as a wall of the construction or another limb. The preferred construction has two opposed limbs, with opposed curved surfaces to hold a metal ball between them, optionally with further opposed curved surfaces to hold one or more further metal balls.

The advantage here is during assembly of the device. Small loose bodies such as metal balls are hard to control, and may escape or become misplaced during assembly or during filling. This may cause product faults, or damage machinery. By retaining the stirrer body in a clip, it remains in place during the assembly and filling stage while being easily deployed subsequently by tapping, knocking or shaking the dispenser so that the body e.g. metal ball breaks free.

The present proposals are desirably embodied in small hand-operated dispensers consisting essentially of moulded plastics components. Pump chamber volumes are not particularly limited but may be e.g. from 1 ml to 25 ml.

BRIEF DESCRIPTION OF THE DRAWINGS

Pump dispensers embodying our proposals are now described with reference to the accompanying drawings.

DESCRIPTION OF THE SELECTED EMBODIMENTS

Figure 1:
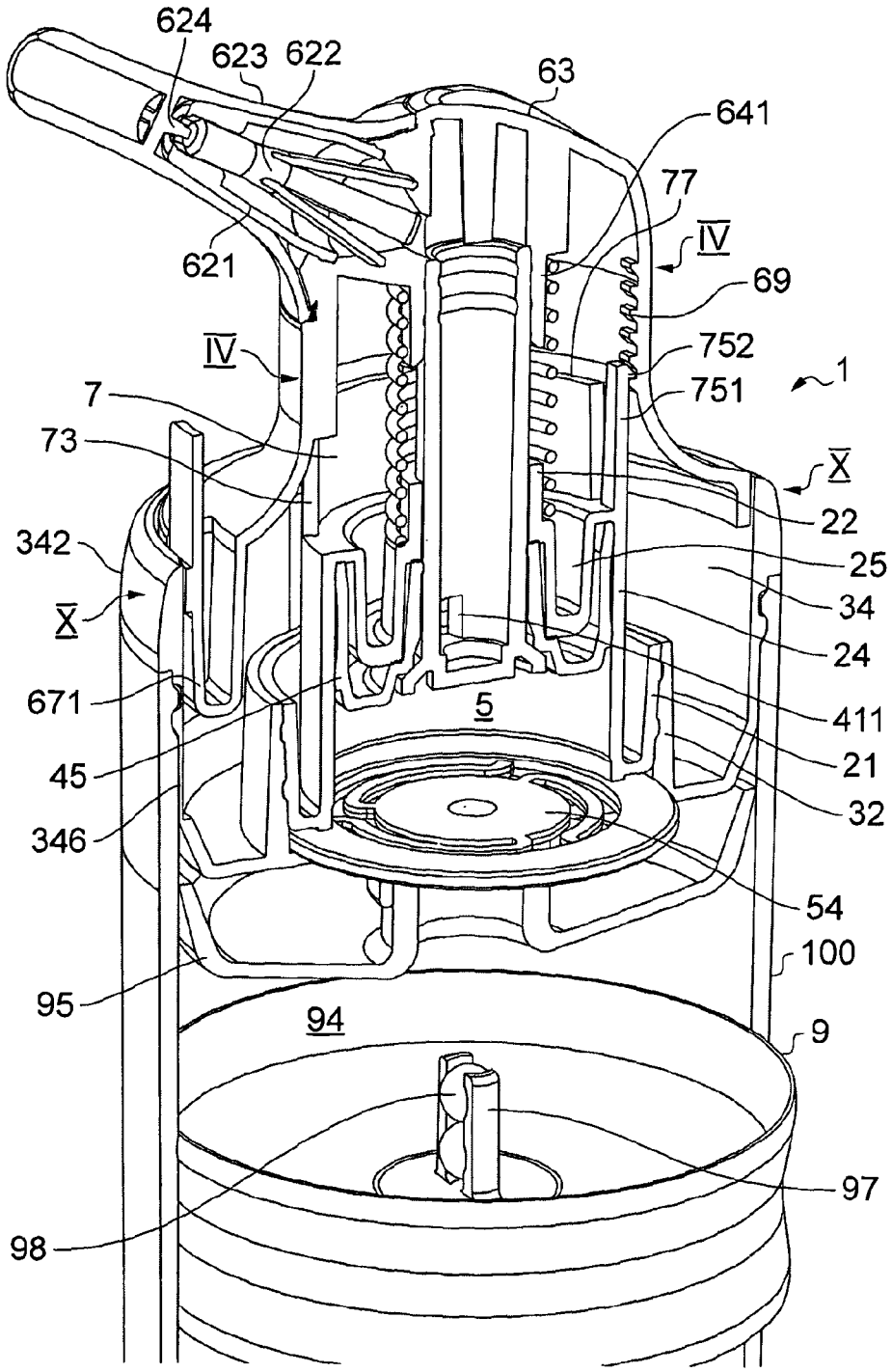
FIG. 1 is a vertical axial section through a pump dispenser with the plunger in an unlocked state ready for incremental dosing.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Figure 2:
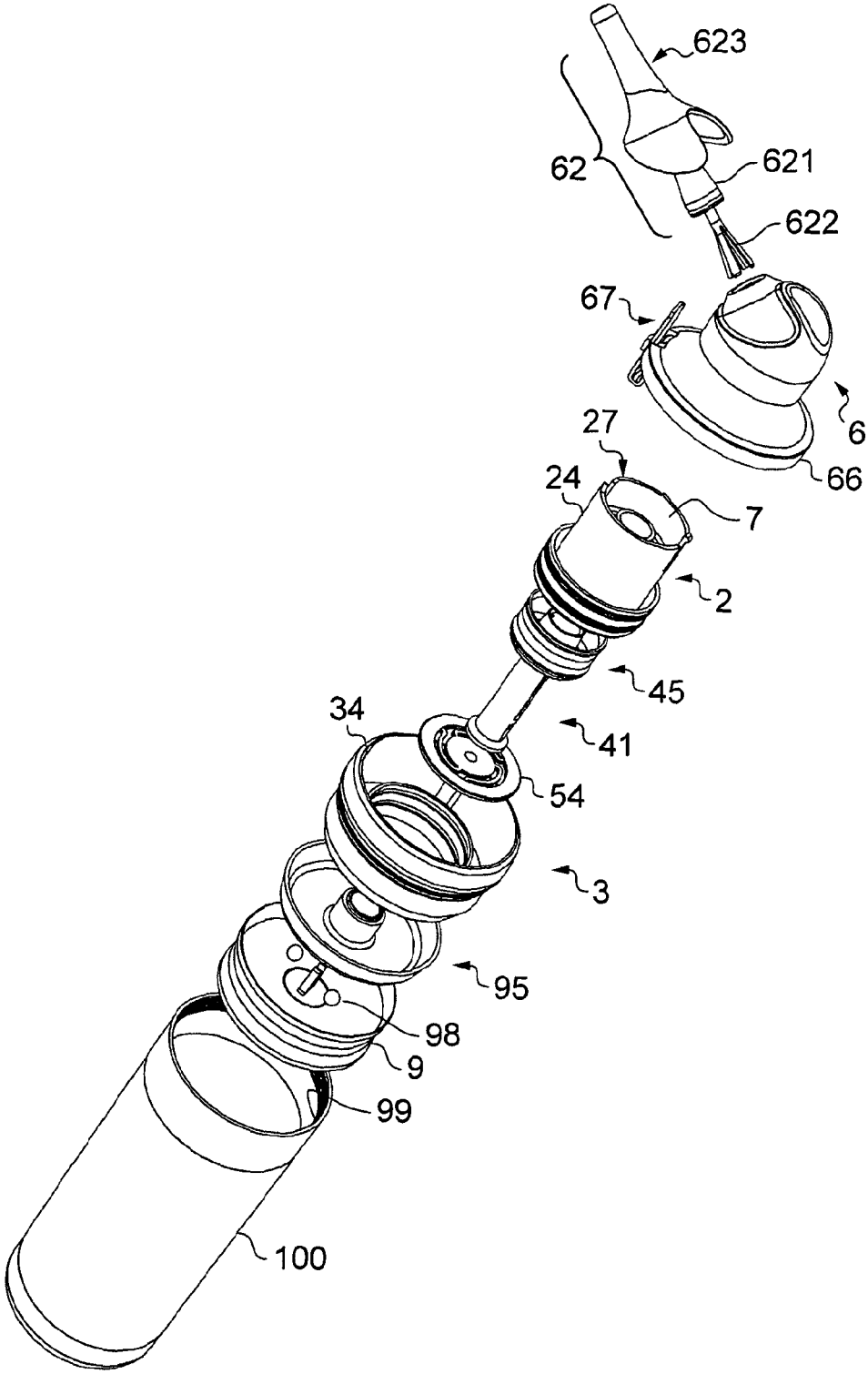
FIG. 2 is an exploded view of the FIG. 1 dispenser showing the main components.
Figure 3:
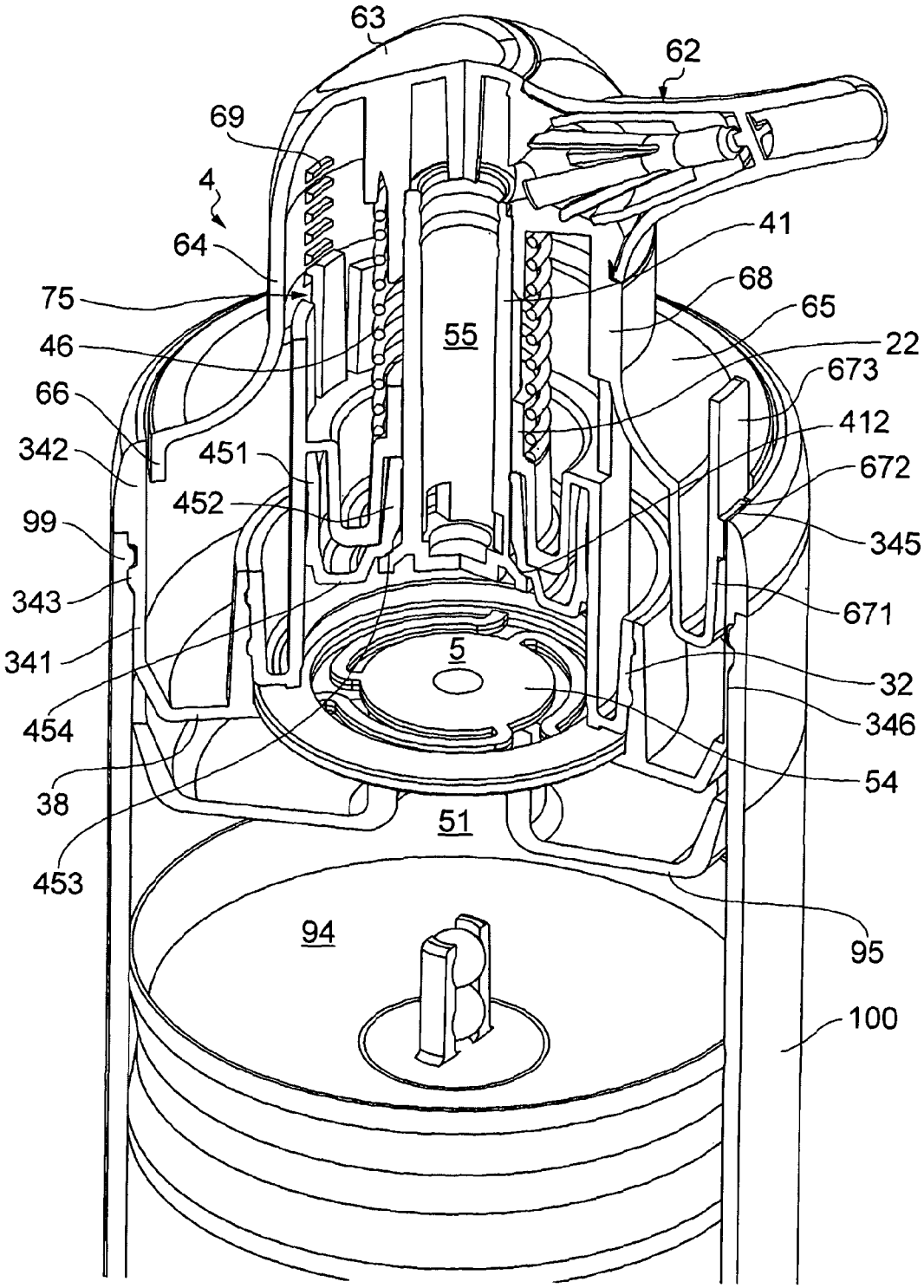
FIG. 3 is a vertical section of the FIG. 1 dispenser, in the same state as in FIG. 1 but sectioned at angled radial planes to show other details of a plunger movement control mechanism.
Figure 4:
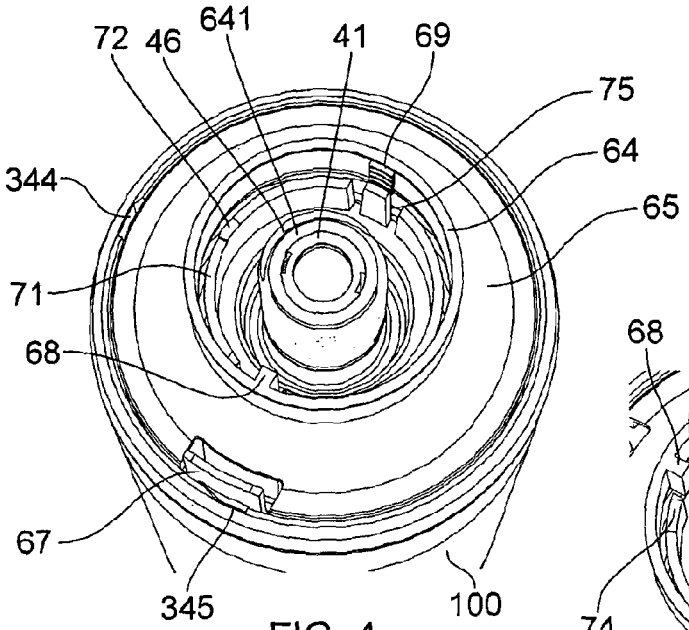
FIG. 4 is a horizontal section at IV-IV of FIG. 1 with the pump in the same state, showing the relationship of components in the plunger movement control mechanism.
Figure 5:
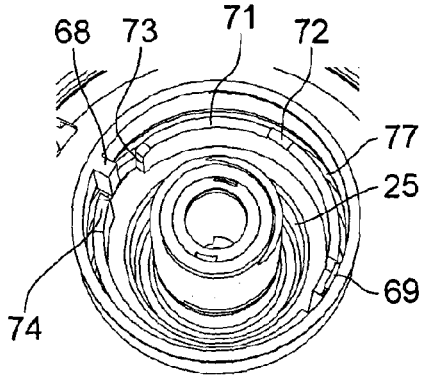
FIG. 5 is the same section as FIG. 4 seen obliquely from the other side.

With reference to FIGS. 1 to 3, a dispenser comprises a container 100 with a pump dispenser unit 1 plugged into its circular top opening by means of snap formations 99,343. The container 100 is a conventional moulded plastics container. A follower piston 9 is sealingly slidable in the container interior.

The main components of the pump unit 1 are a pump mounting plate 3, a pump cylinder body 2, a plunger 4 having a head 6 with a nozzle 62, a stem 41 carrying a piston 45, and an inlet valve 54.

The general disposition of these moveable-nozzle pump components is conventional, although certain refinements are included as described in European Publication No. 2,353,727 published Aug. 10, 2011 and which is based on and claims priority to United Kingdom Application GB100601.0 which was filed on 14 Jan. 2010. This European publication is hereby incorporated by reference in its entirety. The European publication provides nonessential subject matter regarding the nozzle construction. The nozzle construction is therefore not considered in detail in the present specification.

The fixed mounting plate 3 and cylinder body 2 between them constitute a pump body i.e. a generally fixed module relative to which the plunger 4 moves. The mounting plate 3 has a generally bowl-shaped outer surround wall 34, with a lower portion 341 which plugs down into the container top with a snap fit as mentioned above, and an upper portion 342 which forms a surround wall projecting up around the container rim and is instrumental in plunger control as described later. The bottom of the mounting plate 3 has a flat floor 38 with a central upstanding socket 32 into which the cylinder body 2 plugs by snap fit. A flat inlet valve module 54 is clamped into a central inlet opening by the lower snap plug portion 21 of the cylinder body 2, and controls an inlet opening 51. An air trap component 95 is plugged into the underside of the mounting plate and is to prevent any trapped air from reaching the pump inlet. The mounting plate 3 is a one-piece plastics moulding.

The cylinder body 2 is another one-piece moulding, and comprises the axially-vertical cylinder 24 positioned centrally over the inlet opening 51 and valve 54. An upper wall of the cylinder has a first portion shaped as an annular trough 25 and a central portion shaped as a tubular stem guide 22.

The plunger piston 45 has an outer seal 451 which wipes the wall of the cylinder 24, an intermediate trough form 454 approximately complementing the upper wall 25 of the cylinder, and an inner sleeve 452 which fits slidably on a central tubular stem 41 which defines an outlet passage 55. The piston 45 and stem 41 are axially slidable relative to one another over a short distance, bringing respective conical sealing faces 453,412 either into or out of engagement (FIG. 11 which shows them out of engagement) so that the outlet passage is either open for flow via stem windows 411 or closed, as in the FIG. 1 position, to act as an outlet valve. A pump chamber 5 is defined inside the surrounding wall of the cylinder 24 between the piston 45 and stem 41 above and the inlet valve 54 below.

The plunger 4 has a head 6 plugged onto the top of the stem 41 by means of a stem socket 641, completing the outlet passage with a nozzle 62. This nozzle includes a discrete stub nozzle 621 trapping an outwardly-sprung valve body 622 which closes the nozzle outlet except when a nozzle attachment 623 for oral dosing is pushed on. The nozzle attachment has a central actuating projection 624 which pushes the valve 622 open to enable dispensing. This plunger head 6, consisting essentially of another single moulded component, takes the general form of a hollow cap or shell and has a button top 63 for pressing by thumb or finger, a generally upright (substantially cylindrical) wall portion 64 below the button top, a divergent or flaring wall portion 65 below the cylindrical wall 64, and a peripheral vertical skirt 66 which fits closely down inside the upstanding rim or surround 342 of the mounting plate 3.

A metal pump spring 46 fits around the plunger stem 41, trapped between the cylinder stem guide 22 beneath and the stem socket 641 above, and urges the plunger towards the top position shown. The limit for the top position is the engagement of the top of the piston components with the underside of the cylinder top wall 25.

With the pump mounted in the container and the follower plate 9 in place, a product space 94 is defined above the follower plate. This dispenser is designed for use with a medicine composition liable to settling, so metal balls 98 are put in the product space 94; by shaking they can agitate the composition to keep it uniform. A clip formation 97 is moulded integrally with the follower plate 9 and comprises a pair of upstanding limbs, each with a pair of curved recesses dimensioned so that the balls 98 can be clipped between them with mild compression during assembly of the pump. The clip 97 keeps the balls in place during assembly of the other components and filling of product. They can be dislodged for use by a sharp tap.

Now, the distinctive mechanisms for controlling the plunger movement are described. Various functional features are present. Firstly, the plunger cannot be depressed until turned to a working position relative to the body. In the working position, an incremental dosing mechanism (retainer for holding the plunger at intermediate positions) may be either engaged or disengaged, according to the exact rotational alignment. A guide keeps the incremental mechanism engaged unless the user positively moves it to the disengage position to allow the plunger to rise. These working conditions are provided over a plunger rotation sector of about 20-40°. To one side of this "working sector" there is an approximately 50°-100° "locked-up" sector over which the plunger cannot be depressed although it can be freely turned to the working sector. Combined, the locked-up sector and the working sector constitute an operational sector, and limit stops at either end prevent the plunger from rotating to outside this operational sector. Beyond one or both of these limit stops may be a locked-up alignment for shipping or pre-use, where the plunger cannot turn to the working alignment because of the limit stops.

Referring now to specific components, the functions are provided on the one hand by engagements between interior formations on the cylindrical cap wall 64 and upwardly-projecting plunger control formations 27 on the cylinder body 2, and on the other hand between exterior formations on the plunger outer skirt 66 and interior formations on the mounting plate surround 342. Refer additionally to FIGS. 4 to 10.

FIGS. 1, 3, 4 and 5 show the dispenser in a working position in which the plunger can be depressed.

A pump body plunger control formation is provided in the form of an upstanding wall 7 around the top periphery of the cylinder body 2. This wall 7 is formed in one piece with the cylinder body, and with the plunger fully raised as shown reaches up to just inside the generally cylindrical plunger shell wall 64. The wall 7 has a top edge 71 mostly of uniform height. It is interrupted at one side by an open working slot or clearance 73 subtending about 30° and reaching down the full height of the wall. Immediately to one side of this working slot 73 a limit stop abutment 74 projects up above the general height of the wall. The other side of the slot 73 leads to the top edge 71 at the general height via a small chamfer 78. This sector of the wall top edge 71 constitutes a locking abutment surface of an operational sector of the wall (considered as also including the working slot 73), and terminates at another limit stop 72 positioned between 70 and 110° round from the slot 73. These angles are not critical. Limit stop 72 has a perpendicular abutment face directed towards the operational sector and a ramped face in the other direction. Beyond the abutment 72 the wall top surface 77 continues at the same height, and is interrupted at a position opposite the working slot 73 by two further slots defining between them a flexible pawl member 75. This consists of an upstanding limb 751 with an outwardly-projecting pawl tooth 752 at the top, slightly higher than the rest of the wall 7. Beyond the pawl member 75 the peripheral wall 7 continues at the standard height round back to define the other side of the working slot and its limit stop 74; this part of the wall is otherwise non-functional in this embodiment.

To interact with these control formations of the pump body, the inside of the plunger shell wall 64 has at one side a vertical series of inwardly-projecting pawl teeth 69—six teeth in this embodiment—and on the opposite side a solid radially-inwardly projecting locking lug 68 with a downward abutment surface. These elements are positioned and dimensioned such that, with the plunger 4 fully raised as shown and rotated to bring the locking lug 68 against the working position limit stop 74 at the working notch 73 (see FIG. 5), the tooth 752 of the pawl member 75 is aligned and engaged with the series of pawl teeth 69 on the inside of the plunger cap. The limit stop 74 provides a ready means of locating this position quickly. The cap can then be depressed to dispense according to a normal dispensing mechanism, subject to certain refinements such as vertical lifting of the flap of the inlet valve 54, opening of the plunger stem windows 411 with lost motion relative to the piston 45 as described in the United Kingdom application which is incorporated by reference by way of the European publication, and reliance on the special nozzle closure 622 being opened by the presence of a discrete nozzle attachment 623. As the plunger descends, the body pawl 75 clicks over the cap pawl teeth 69 with resilient flexion and the locking lug 68 descends into the working notch 73. At any stage the plunger can be released and, attempting to rise under the influence of the spring 46, will be retained as soon as the perpendicular abutment surface on the bottom of the pawl tooth 752 meets the corresponding perpendicular abutment surface of the next adjacent cap tooth 69. The plunger therefore substantially holds its position, and the dispensing of the dose in the chamber can be continued subsequently after an interval. At the end of the stroke or at any stage the plunger can be turned through about 20° to the position seen in FIGS. 6 and 7. The locking lug 68 moves to the other side of the working slot 73 (and will abut against it if the plunger has been depressed at all); the body pawl member 75 rotates out of engagement with the cap teeth 69 (FIG. 6) and the plunger is then free to rise, re-charging the pump chamber 5 through the inlet valve 54 in the conventional way.

Clockwise rotation of the plunger 4 from the working position brings the locking lug 68 to above the top edge 71 of the body wall 7, providing a locked-up state in which the plunger cannot be depressed. This state exists for any rotational position of the plunger with the locking lug 68 between the working slot 73 and the limit stop 72 further round the wall top edge 71. Thus, the limit stop 72 serves as a convenient means for quickly rotating the plunger to a position safely distant from the working slot 73 so that product will not accidentally be dispensed.

Figure 11:
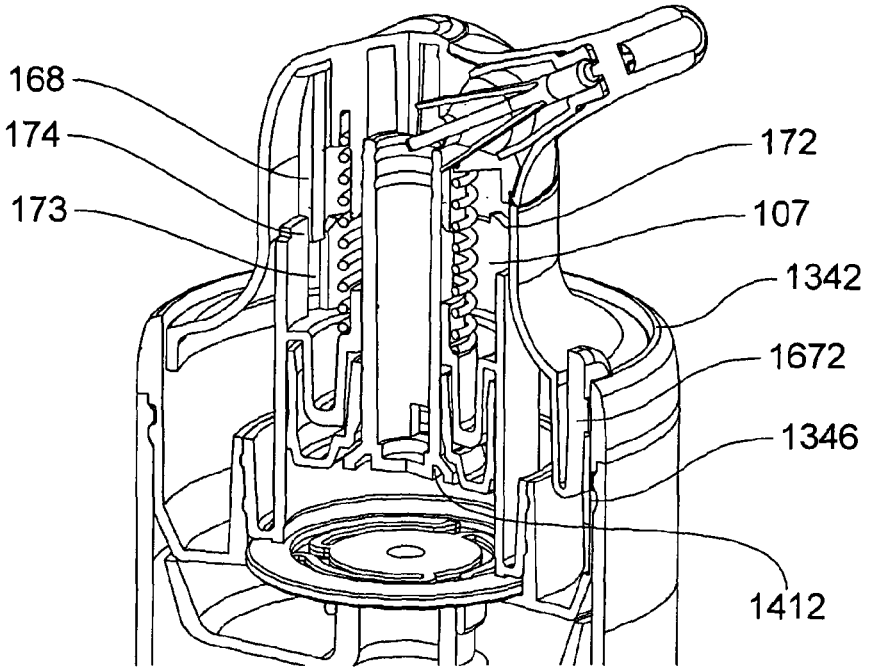
FIG. 11 is a sectional view corresponding to FIG. 3 but of a second pump embodiment with a variant of the internal components of the plunger control mechanism, the plunger being shown in a working (unlocked) state and partly depressed.
Figure 12:
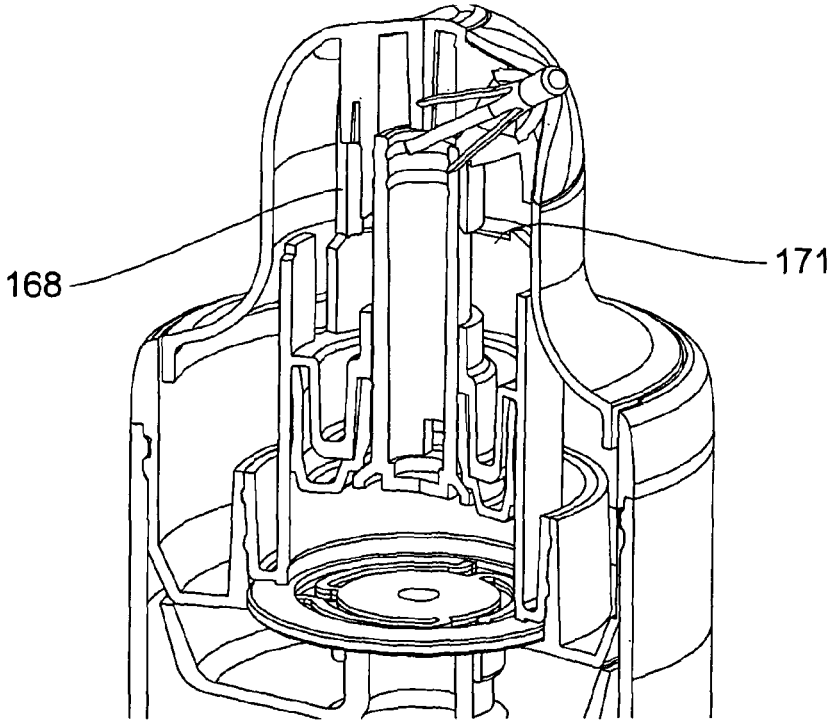
FIG. 12 is a view corresponding to FIG. 11 but with the plunger fully raised and rotated to a locked position.

Here, reference should be made to the variant embodiment shown in FIGS. 11 and 12. In these figures corresponding components of the same reference numerals with 100 added. In this embodiment the incremental ratchet feature is not included, so engaged/disengaged working states are not needed and the working slot 173 can be narrower. The locking lug 168 is provided here at the side of the shell opposite the nozzle. The working position and locking position limit stops 174,172 are essentially the same.

The plunger control mechanisms described above provide for a circumferentially-localised working alignment which must be selectively found from an otherwise locked condition, and (in the first embodiment) an incremental dosing function which can be disengaged.

The additional locking features at the exterior of the plunger cap provide for additional control, selectivity and child-resistance.

FIGS. 1, 2 and 3 show an outer spring locking member 67 integrally moulded at one position on the periphery of the plunger skirt 65,66, interrupting the otherwise close clearance between the plunger skirt 66 and the mounting surround 342. The locking member 67 is an integrally-moulded U-shaped spring 671 extending downward, outward and then upward. The upward limb of the U has on its outward face a circumferentially-directed catch pawl or tooth 672, and projects up beyond the tooth as a push tab 673 above the mounting surround 342.

The interior surface of the mounting surround 342 is mostly smoothly cylindrical as seen in FIG. 2, but is interrupted at two positions, separated approximately by a right-angle, by a working position catch recess 345 and a shipping position catch recess 344, each shaped to fit the locking member catch pawl 672, on the inside near the top rim. The U-shaped spring 671 is dimensioned so that, with the plunger mounted in the pump body surround, it is lightly biased outwardly against the surround so that the catch pawl 672 will seat in whichever of the catch recesses 344,345 should come into register with it. In such a position the plunger cannot be turned in the direction towards the abutment face of the catch pawl unless the push tab 673 is pushed inwards to release it. It can be turned in the other direction if sufficient turning force is applied to bend the spring inwards by cam action on the catch pawl ramp.

The locking member 67 is positioned on the plunger periphery so that when it engages with the working position catch recess 345 of the body surround (FIGS. 1, 3, 4, 5) the internal mechanism is in the working position with the ratchet teeth 69 aligned. The catch recess 345 continues downwards as a track or channel 346—visible as reduced wall thickness in FIGS. 1 and 3—so that the locking member 67 can travel down inside the surround as the plunger is depressed, guided to prevent plunger rotation that would shift the internal body pawl member 75 out of engagement with the ratchet teeth 69. Such disengagement must be done deliberately, as shown in FIGS. 6 and 7, by forcibly turning the plunger slightly clockwise to drive the locking member spring 671 inwards (up the ramp of its catch pawl 672), turning movement being then limited by the internal locking lug 68 meeting the opposite face of the working slot 73 (FIG. 7).

Figure 6:
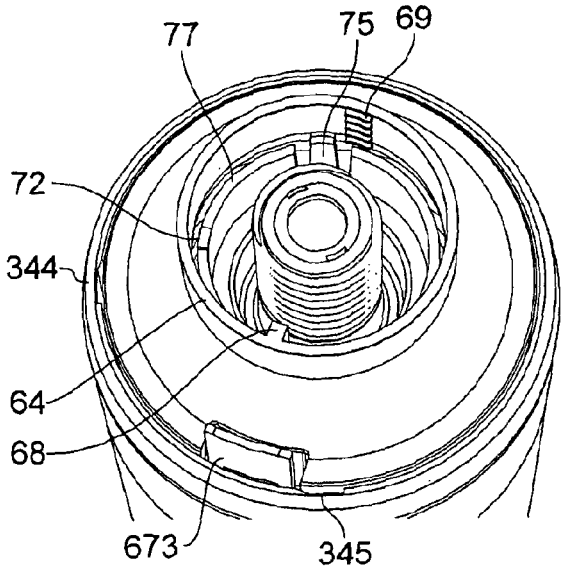
FIGS. 6 and 7 are views corresponding to FIGS. 4 and 5 but with the pump plunger rotated slightly to a disengaged or released position.
Figure 7:
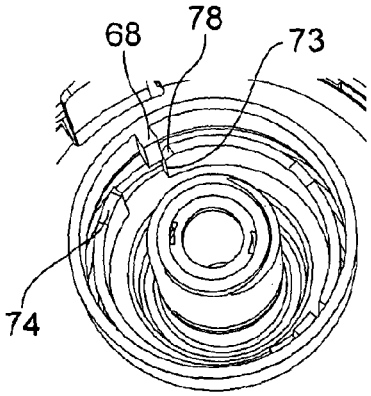
Figure 8:
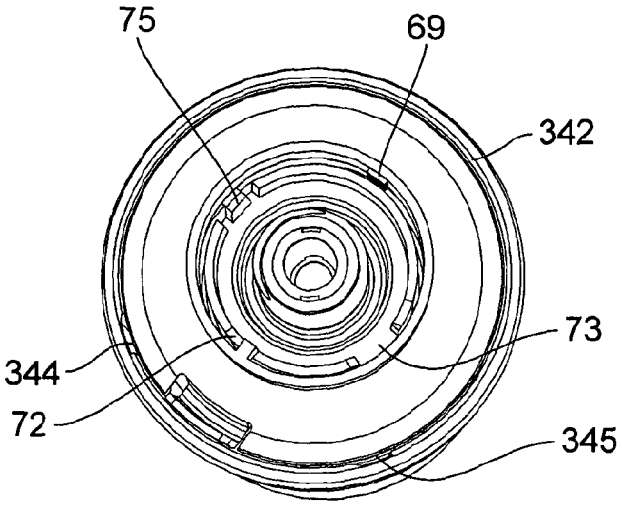
FIGS. 8 and 9 are views corresponding to FIGS. 4 and 5 with the plunger rotated to a locked position.
Figure 9:
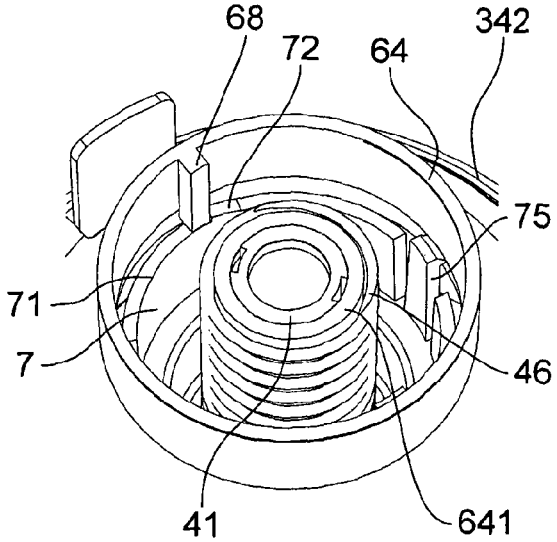
Figure 10:
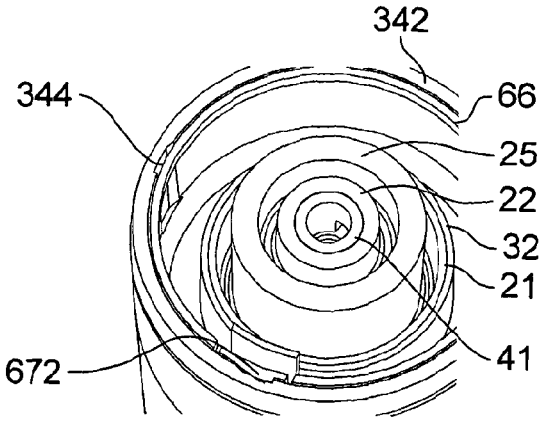
FIG. 10 is a horizontal section at X-X of FIG. 1.

The other catch recess 344 of the body surround is positioned for shipping: the locking member 67 seats in it in a the rotational alignment with the locking lug 68 on the "wrong" side of the limit stop 72, over the locking surface 77 seen in FIG. 6. In this position the plunger cannot be depressed, nor can it be rotated to a position in which it can be depressed, because it is separated from the operational sector by the limit stop 72 and the pawl projection 75 (or, in the FIGS. 11, 12 embodiment, by the limit stops 72,74). The dispenser cannot be used unless the user pushes the tab 673 to release the member 67 from the catch recess 344 and rotates the plunger forcibly anti-clockwise so that the lug 68 rides over the ramp of the limit stop 72 and into the operating sector. In the FIG. 11 embodiment, it may be rotated in either direction for this purpose. This complex "initiating" action is very child-resistant.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A pump dispenser for dispensing fluid product from a supply container, said pump dispenser having a pump chamber with a valved inlet to communicate with the supply container and an outlet, the pump dispenser comprising a plunger and a pump body relative to which the plunger is reciprocable to alter the volume of the pump chamber in a dispensing stroke to dispense fluid product from the fluid outlet, wherein the pump dispenser having top and bottom limit positions for the plunger relative to the pump body and the plunger being biased towards the top limit position, wherein the improvement comprises:

a first engagement structure as part of said pump body; and a second engagement structure as part of said plunger, said second engagement structure being constructed and arranged to cooperate with said first engagement structure for retaining said plunger at an axially intermediate position between said top limit position and said bottom limit position, wherein said plunger is constructed and arranged to be rotated for disengagement of said first engagement structure and said second engagement structure when said plunger is at a said axially intermediate position.

2. The pump dispenser of claim 1 wherein with said first and second engagement structures disengaged, said plunger is constructed and arranged and biased relative to said pump body to move to said top limit position.

3. The pump dispenser of claim 1 wherein said first engagement structure includes a flexible member.

4. The pump dispenser of claim 1 wherein said second engagement structure includes a spaced plurality of individual engagement members.

5. The pump dispenser of claim 1 which further includes a plunger head with a locking member.

6. The pump dispenser of claim 5 which further includes a mounting plate defining a dispensing recess which is constructed and arranged for receipt of said locking member.

7. The pump dispenser of claim 6 which is constructed and arranged wherein said first engagement structure and said second engagement structure are in engagement when said locking member is received by said dispensing recess.

8. The pump dispenser of claim 6 wherein said dispensing recess is constructed and arranged to enable plunger travel in an axial direction.

9. The pump dispenser of claim 6 wherein with said locking member received within said dispensing recess, plunger rotation is prevented.

10. The pump dispenser of claim 6 wherein said plunger is constructed and arranged to be able to rotate relative to said pump body for selective disengagement of said first and second engagement structures.

11. The pump dispenser of claim 10 wherein with said first and second engagement structures disengaged, said plunger is constructed and arranged and biased relative to said pump body to move to said top limit position.

12. The pump dispenser of claim 6 wherein said first engagement structure includes a flexible member.

13. The pump dispenser of claim 12 wherein said second engagement structure includes a spaced plurality of individual engagement members.

14. The pump dispenser of claim 5 which further includes a mounting plate defining a shipping recess which is constructed and arranged for receipt of said locking member.

15. A pump dispenser for dispensing fluid product from a supply container, said pump dispenser having a pump chamber with a valved inlet to communicate with the supply container and an outlet, the pump dispenser comprising a plunger and a pump body relative to which the plunger is reciprocable to alter the volume of the pump chamber in a dispensing stroke to dispense fluid product from the fluid outlet, wherein the pump dispenser having top and bottom limit positions for the plunger relative to the pump body and the plunger being biased towards the top limit position, wherein the improvement comprises:

a plunger head with a locking member; and a mounting plate defining a dispensing recess which is constructed and arranged for receipt of said locking member, wherein with said locking member positioned in said dispensing recess, said plunger is able to be advanced for initiating dispensing.

16. The pump dispenser of claim 15 wherein with said locking member received within said dispensing recess, plunger rotation is prevented.

17. The pump dispenser of claim 15 wherein plunger rotation is enabled by disengaging said locking member from within said dispensing recess.

18. The pump dispenser of claim 15 which further includes a mounting plate defining a shipping recess which is constructed and arranged for receipt of said locking member.

19. A pump dispenser for dispensing fluid product from a supply container, said pump dispenser having a pump chamber with a valved inlet to communicate with the supply container and an outlet, the pump dispenser comprising a plunger and a pump body relative to which the plunger is reciprocable to alter the volume of the pump chamber in a dispensing stroke to dispense fluid product from the fluid outlet, wherein the pump dispenser having top and bottom limit positions for the plunger relative to the pump body and the plunger being biased towards the top limit position, wherein the improvement comprises:

a first engagement structure as part of said pump body;

a second engagement structure as part of said plunger, said second engagement structure being constructed and arranged to cooperate with said first engagement structure for retaining said plunger at an axially intermediate position between said top limit position and said bottom limit position;

a plunger head with a locking member; and a mounting plate defining a dispensing recess which is constructed and arranged for receipt of said locking member.

20. The pump dispenser of claim 19 which is constructed and arranged wherein said first engagement structure and said second engagement structure are in engagement when said locking member is received by said dispensing recess.

21. The pump dispenser of claim 19 wherein said dispensing recess is constructed and arranged to enable plunger travel in an axial direction.

22. The pump dispenser of claim 19 wherein with said locking member received within said dispensing recess, plunger rotation is prevented.

23. The pump dispenser of claim 19 wherein said plunger is constructed and arranged to be able to rotate relative to said pump body for selective disengagement of said first and second engagement structures.

24. The pump dispenser of claim 23 wherein with said first and second engagement structures disengaged, said plunger is constructed and arranged and biased relative to said pump body to move to said top limit position.

25. The pump dispenser of claim 19 wherein said first engagement structure includes a flexible member.

26. The pump dispenser of claim 25 wherein said second engagement structure includes a spaced plurality of individual engagement members.

27. A pump dispenser for dispensing fluid product from a supply container, said pump dispenser having a pump chamber with a valved inlet to communicate with the supply container and an outlet, the pump dispenser comprising a plunger and a pump body relative to which the plunger is reciprocable to alter the volume of the pump chamber in a dispensing stroke to dispense fluid product from the fluid outlet, wherein the pump dispenser having top and bottom limit positions for the plunger relative to the pump body and the plunger being biased towards the top limit position, wherein the improvement comprises:

a first engagement structure as part of said pump body;

a second engagement structure as part of said plunger, said second engagement structure being constructed and arranged to cooperate with said first engagement structure for retaining said plunger at an axially intermediate position between said top limit position and said bottom limit position;

a plunger head with a locking member; and a mounting plate defining a shipping recess which is constructed and arranged for receipt of said locking member.

28. The pump dispenser of claim 27 wherein with said locking member positioned in said shipping recess, said pump dispenser is adapted to prevent plunger travel in an axial direction.

29. The pump dispenser of claim 27 wherein said mounting plate further defining a dispensing recess which is constructed and arranged for receipt of said locking member.

30. The pump dispenser of claim 29 which is constructed and arranged wherein said first engagement structure and said second engagement structure are in engagement when said locking member is received by said dispensing recess.

31. The pump dispenser of claim 29 wherein said dispensing recess is constructed and arranged to enable plunger travel in an axial direction.

32. The pump dispenser of claim 29 wherein with said locking member received within said dispensing recess, plunger rotation is prevented.

33. The pump dispenser of claim 29 wherein said plunger is constructed arranged to be able to rotate relative to said pump body for selective disengagement of said first and second engagement structures.

34. A pump dispenser for dispensing fluid product from a supply container, said pump dispenser having a pump chamber with a valved inlet to communicate with the supply container and an outlet, the pump dispenser comprising a plunger and a pump body relative to which the plunger is reciprocable to alter the volume of the pump chamber in a dispensing stroke to dispense fluid product from the fluid outlet, wherein the pump dispenser having top and bottom limit positions for the plunger relative to the pump body and the plunger being biased towards the top limit position, wherein the improvement comprises:

a first engagement member as part of said pump body; and a single plurality of second engagement members as part of said plunger, said first engagement member being constructed and arranged to cooperate with said single plurality of second engagement members for retaining said plunger at an axially intermediate position between said top limit position and said bottom limit position.

35. The pump dispenser of claim 34 wherein with said first and second engagement structures disengaged, said plunger is constructed and arranged and biased relative to said pump body to move to said top limit position.

36. The pump dispenser of claim 34 wherein said first engagement structure includes a flexible member.

37. The pump dispenser of claim 34 wherein said second engagement structure includes a spaced plurality of individual engagement members.

38. The pump dispenser of claim 34 which further includes a plunger head with a locking member.

39. A pump dispenser for dispensing fluid product from a supply container, said pump dispenser having a pump chamber with a valved inlet to communicate with the supply container and an outlet, the pump dispenser comprising a plunger and a pump body relative to which the plunger is reciprocable to alter the volume of the pump chamber in a dispensing stroke to dispense fluid product from the fluid outlet, wherein the pump dispenser having top and bottom limit positions for the plunger relative to the pump body and the plunger being biased towards the top limit position, wherein the improvement comprises:

said pump body including a first engagement structure which cooperates with said plunger; and said plunger including a second engagement structure which cooperates with a mounting plate and is spaced apart from said first engagement structure.

40. The pump dispenser of claim 39 wherein said plunger is constructed and arranged to be rotated for disengagement of said first engagement structure and for disengagement of said second engagement structure when said plunger is at an axially intermediate position between said top and bottom limit positions.

41. The pump dispenser of claim 39 which further includes a plurality of projections for engagement with said first engagement structure.

42. The pump dispenser of claim 39 which further includes a dispensing recess which is constructed and arranged for receipt of said second engagement structure.

43. The pump dispenser of claim 39 wherein said plunger includes a locking lug.

44. The pump dispenser of claim 43 wherein said pump body includes a limit stop which is constructed and arranged to cooperate with said locking lug.

45. The pump dispenser of claim 39 wherein said first engagement structure is constructed and arranged for use in setting said plunger at an intermediate position between said top and bottom limit positions.

46. The pump dispenser of claim 39 wherein said second engagement structure is constructed and arranged for use in permitting axial travel of said plunger.

47. The pump dispenser claim 39 wherein disengagement of said second engagement structure from said mounting plate enables said first engagement structure to disengage from said plunger.

* * * * *